US009284161B2

(12) United States Patent
Hey

(10) Patent No.: US 9,284,161 B2
(45) Date of Patent: Mar. 15, 2016

(54) SELF-BALANCING SPREADER BEAM

(71) Applicant: National Oilwell Varco, L.P., Houston, TX (US)

(72) Inventor: John E. Hey, Spring, TX (US)

(73) Assignee: National Oilwell Varco, L.P., Houston, TX (US)

( * ) Notice: Subject to any disclaimer, the term of this patent is extended or adjusted under 35 U.S.C. 154(b) by 15 days.

(21) Appl. No.: 14/264,727

(22) Filed: Apr. 29, 2014

(65) Prior Publication Data

US 2015/0307328 A1 Oct. 29, 2015

(51) Int. Cl.
*B66C 1/10* (2006.01)

(52) U.S. Cl.
CPC ..... *B66C 1/10* (2013.01)

(58) Field of Classification Search
USPC ..... 294/81.3, 82.3, 67.21, 67.1, 67.5, 81.4, 294/81.5, 81.21, 81.54; 414/10, 11, 607, 414/469
See application file for complete search history.

(56) References Cited

U.S. PATENT DOCUMENTS

| | | | | |
|---|---|---|---|---|
| 3,762,755 | A * | 10/1973 | Saether | 294/67.21 |
| 4,487,741 | A * | 12/1984 | Vuckovich et al. | 376/271 |
| 4,648,647 | A * | 3/1987 | Patton | 294/67.1 |
| 5,086,901 | A * | 2/1992 | Petronis et al. | 192/150 |
| 7,891,718 | B2 * | 2/2011 | Heinaman | 294/81.3 |
| 2010/0011883 | A1 * | 1/2010 | Werber et al. | 73/862.391 |
| 2011/0221215 | A1 * | 9/2011 | Botwright | 294/81.4 |

FOREIGN PATENT DOCUMENTS

| | | |
|---|---|---|
| CN | 2097198 | 2/1992 |
| FR | 2746783 | 10/1997 |
| GB | 1360190 | 7/1974 |
| JP | S55167975 | 12/1980 |
| JP | H07309580 | 11/1995 |
| WO | 2012114319 | 8/2012 |

OTHER PUBLICATIONS

International Search Report and Written Opinion for related PCT Application No. PCT/US2014/068163 mailed Mar. 5, 2015 (10 pages).
Below the Hook Lifters for Cranes & Hoists Catalog, CM Cady, copyright 2013 (67 pages).
"Lifting Spreader Beams", Global Industrial, copyright 2014. Accessed on the Internet Sep. 8, 2014 <URL: http:// www.globalindustrial.com/c/material-handling/hoists-cranes/lifting-spreader-beams> (9 pages).

* cited by examiner

*Primary Examiner* — Paul T Chin
(74) *Attorney, Agent, or Firm* — Winthrop & Weinstine, P.A.

(57) ABSTRACT

A lifting device may include a level setting portion and an adjustable beam assembly pivotally secured to the level setting portion and including a structural beam portion and an adjustment portion configured for translating along the structural beam portion, where the adjustable beam assembly includes a sensor for sensing when the structural beam portion is unbalanced and an actuation system for translating the adjustment portion to bring the structural beam portion into a balanced condition.

19 Claims, 6 Drawing Sheets

SELF-BALANCING SPREADER BEAM

FIELD OF THE INVENTION

The present application relates to rigging for cranes and other material handling systems. More particularly, the present application relates to a spreader beam for use with a material handling system to lift broadly extending objects while maintaining the objects in a balanced condition. Still more particularly, the present application relates to a self-balancing spreader beam that automatically adjusts based on sensed conditions to maintain the object in a balanced condition.

BACKGROUND

Lifting of broadly extending objects, and particularly large objects, with material handling systems may involve preliminary design steps to establish one or more pick point locations. The number of pick points and their locations may be selected to ensure that the stresses on the lifted object do not exceed allowable or design stresses on the object and may also be selected to ensure that no particular point would exceed the tensile capacity or design stress of the picking lines or slings, for example. In addition to these stress related considerations, the lifting design may give consideration to aligning the main lifting line with the center of gravity of the lifted object so as to maintain the object in a balanced condition during lifting of the object.

In some cases, insufficient time for a full design may be available or taking time to complete the design may delay the process. This may be particularly true during erection or decommissioning of a structure, for example. In the latter case, the particular size and shape of the parts and pieces that are removed and need to be handled may be unanticipated or unexpected. When lifting these parts and pieces, several attempts may often be made by slightly lifting the element to ensure it is balanced before fully lifting the element. Where imbalances are found, the part or piece may be set back down and a spreader beam may be manually adjusted to pick at different locations on the part or from different points along the spreader beam. This iterative process is slow, time consuming, and potentially dangerous.

BRIEF SUMMARY

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

In one embodiment, a lifting device may include a level setting portion and an adjustable beam assembly pivotally secured to the level setting portion. The adjustable beam assembly may include a structural beam portion and an adjustment portion configured for translating along the structural beam portion. The adjustable beam assembly may include a sensor for sensing when the structural beam portion is unbalanced and an actuation system for translating the adjustment portion to bring the structural beam portion into a balanced condition.

In another embodiment, a lifting device may include a spreader beam configured for picking broad objects with a plurality of slings. The spreader beam may include a means for defining a level condition. The spreader beam may also include a means for adjusting the beam to bring the beam into a balanced condition when the beam is determined to not be level.

In another embodiment, a method of balancing a spreader beam may be provided. In this embodiment, the method may include sensing a non-level condition of the spreader beam and translating a portion of the spreader beam to bring the beam into a condition of balance.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present application, in some embodiments, relates to a self-balancing spreader beam system. The beam may be configured to provide a plurality of picking lines extending downward from the beam to pick points on an object to be lifted. The spreader beam may have self-adjusting to actively adjust the center of gravity of the lifting force relative to that of the center of gravity of the lifted object. That is, the spreader beam may include one or more sensors for sensing the state of balance or the loads imparted on the beam and the beam may include actuators and other elements to adjust the location of the lifting points on the beam relative to the beams support point. By adjusting the relative location of the lifting points in one direction or another, the load on the beam may be brought into balance about its support point.

The automatic adjustability may allow for more efficient lifting operations by reducing the time it may take to lift and move an object because the beam may automatically come into balance and balancing iterations may be avoided. Still further, the design and calculations involved in lifting operations may be reduced and time may be saved accordingly. One particularly advantageous use of the system may be for erecting and/or decommissioning oil rigs where large elements with a wide variety of shapes and sizes may be lifted off of a rig and on to a transport vessel, for example.

Figure 1:
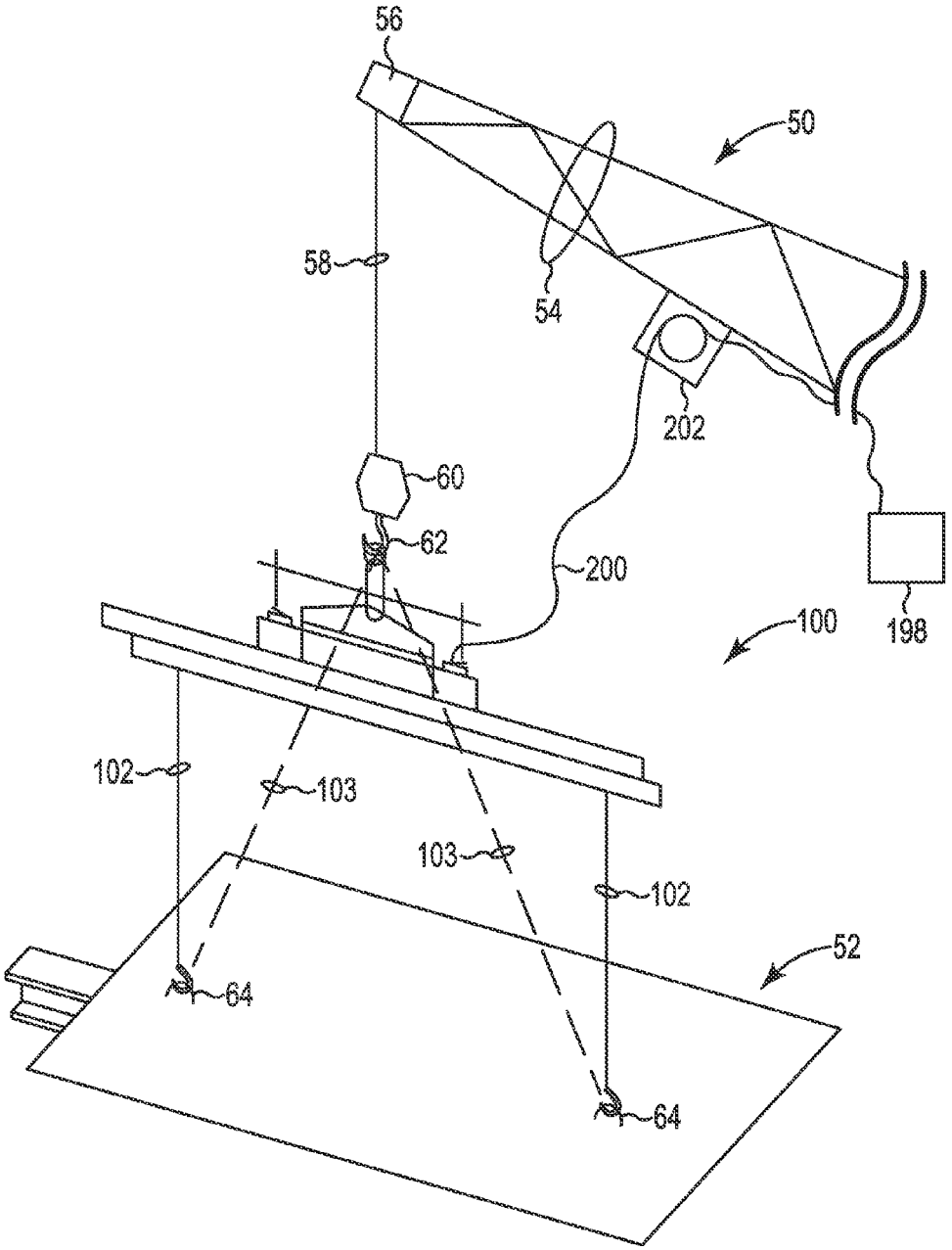
FIG. 1 shows a material handling system using an automatic spreader beam, according to one or more embodiments.

Referring now to FIG. 1, a material handling system 50 is shown using a self-adjusting spreader beam 100 to handle an object 52. As shown, the material handling system 50 may, for example, include a boom crane having a boom 54 with a crown block 56 at its distal end. A lifting line 58, extending from a winch, for example, may extend upward along the boom to the crown block 56 and down to a traveling block 60. While a single line between the crown block 56 and the traveling block 60 is shown, it is to be appreciated that multiple returns may be used where the returns are reeved through the crown block 56 and down to the traveling block 60 again such that multiple lines may be used to support the lifted load. The travelling block 60 may include a lifting hook 62 for picking up loads via lifting lugs, slings, or other mechanisms. In the present case, the self-adjusting spreader beam 100 may be secured to the lifting hook 62 such that multiple slings 102 may be extended generally vertically down to the lifted object 52 without imparting substantial compressive forces on the object. That is, in contrast to using a pair of slings 103 extending directly from the hook 62 to the lifting lugs 64 in a triangular fashion, the spreader beam 100 spreads out the lifting locations allowing the slings 102 to extend generally vertically downward to the lifting lugs 64. As such, substantial compressive forces in combination with bending forces may be avoided in the lifted object 52 and the center of gravity of the load relative to the lifting force may be controlled.

Figure 2:
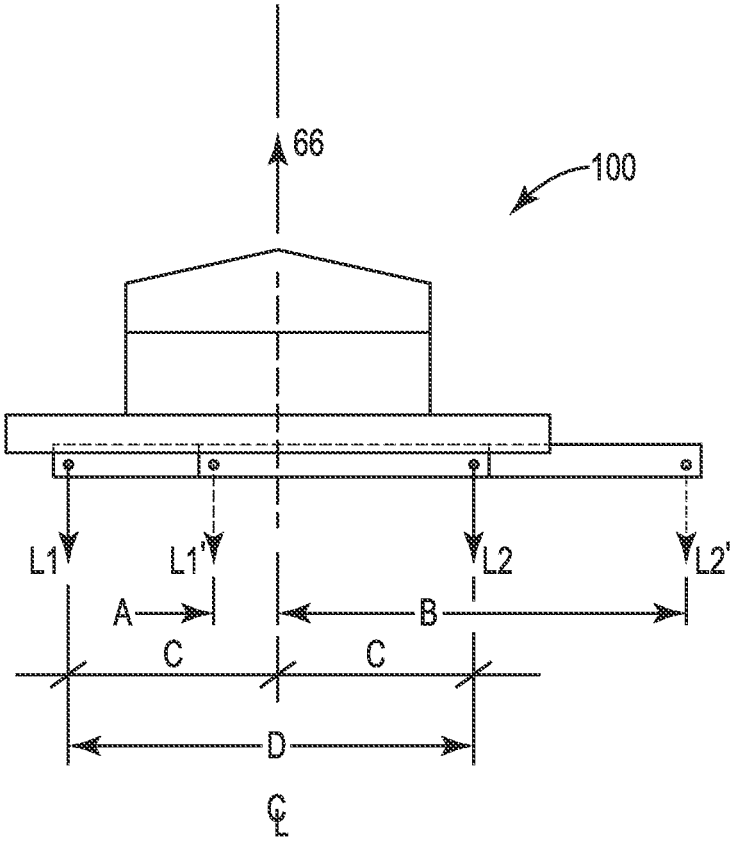
FIG. 2 shows a free body diagram of the spreader beam of the system of FIG. 1, according to one or more embodiments.

Turning now to FIG. 2, a free body diagram of forces that may be imparted on the spreader beam 100 are shown. As shown in FIG. 2, the beam 100 may include a lifting ring defining a centerline of a lifting force 66. For the lifted load to be in a state of balance, the center of gravity of the lifted load may be arranged directly below and along the centerline of the lifting force (i.e., in line with the lifting line or the center of several lifting lines extending between the crown block and the travelling block). It is to be appreciated that the where more than one line or sling 102 is used to lift an object, the center of gravity may be located at some point between the connection of the slings 102 to the object 52 and may be located based on the amount of the load in each sling 102. For example, if each sling carries approximately 50% of the load, then the center of gravity may be located approximately ½ way between the points. If, for example, one sling carries 75% of the load and the other sling carries 25% of the load, the center of gravity may be located ¼ of the way from the heavier sling load toward the lighter sling load.

Referring again to FIG. 2, in some cases, the load L1/L2 on each of the slings extending downward from the spreader beam may be equal or substantially equal. In these cases, for a balanced condition, the distance C from each of the loads to the centerline of the lifting force may be substantially the same. For example, the moment force L1×C may be equal to L2×C and the beam may be balanced. However, where the loads L1'/L2' are different, the position of the loads may be shifted such that the resulting moment force about the centerline of the lifting force is substantially equal. For example, the position of the loads L1'/L2' relative to the centerline of the lifting force may be adjusted such that moment force L1'×A is equal to L2'×B.

It is to be appreciated that the present embodiment is arranged such that the distance D between the loads is maintained where 2C=D and A+B=D. In other embodiments, adjustments may be made where the distance between the loads varies. However, it is to be appreciated that maintaining the distance between the loads may allow for the bending moment imparted on the spreader beam 100 to be controlled. That is, for any given total object weight, F, and a load spacing, D, the moment M in the spreader beam may be the same. For example, where the lugs on the object are arranged to equally distribute the load to each of two slings, the tension in each sling may be F/2 and each sling may be arranged at a distance C from the centerline of the lifting force such that the moment M is F/2×C. Where the lugs on the object are not arranged to equally distribute the load, the tension in one sling may be higher than the other sling, but as the beam adjusts to balance the load, the bending moment M may be maintained at F/2×C because any given tension (which is some fraction of the load F) multiplied its by its distance from the centerline of the load (i.e., A or B) will be equal to F/2×C.

Figure 3:
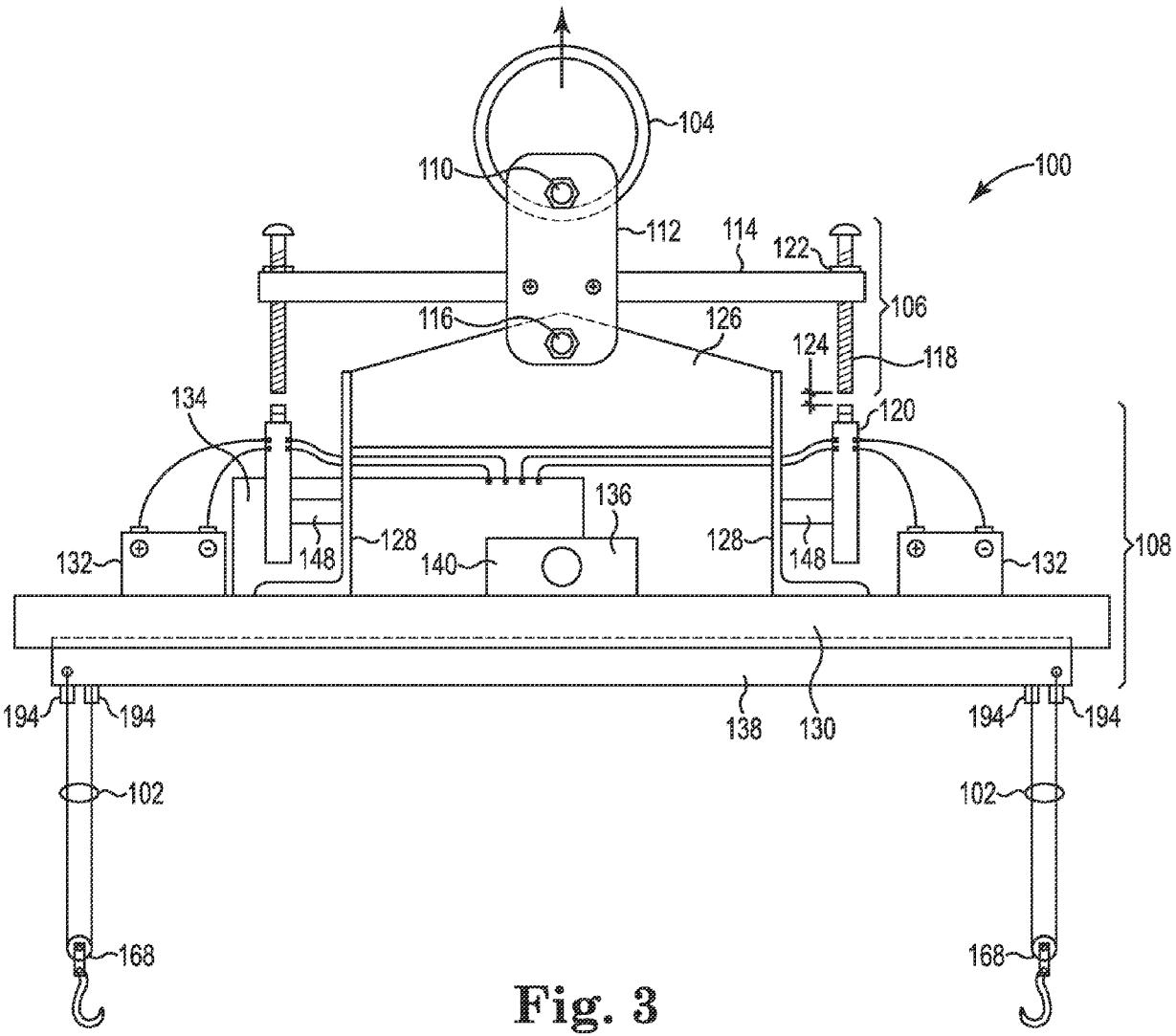
FIG. 3 shows a front side view of the spreader beam of the system of FIG. 1, according to one or more embodiments.

Referring now to FIG. 3, a close-up view of the self-adjusting spreader beam is shown. The beam may include a lifting loop 104, a level setting portion 106, and an adjustable beam assembly 108. The beam 100 may be configured for being slingingly connected to an object 52 and, upon lifting, self-adjusting to maintain the lifted object 52 in a balanced condition. While much discussion has been included to explain the bases for and conditions under which a load may be balanced, the beam 100 shown may self-adjust to find a balanced condition based on a leveling system that may result in balanced forces. This is in contrast to a system that may sense forces, for example, and adjust based on an effort to equalize those or related forces. In the present system, a portion of the system may tip relative to another portion of the system and this tipping may trigger the beam to self-adjust to reduce or eliminate the tipping condition. When the beam returns to a level condition from a tipped condition, the result may be that the bending moments about the centerline of the lifting line may be substantially equalized. The several parts of the self-adjusting spreader beam 100 may now be described in detail.

The lifting loop 104 may include a lug, ring, or other device for receiving a hook 62, for example, from a lifting line 58. For example, as shown in FIG. 1, the lifting line 58 may include a travelling block 60 with a lifting hook 62. The hook 62 may be used to engage the lifting loop 104 on the beam 100 and raise the beam together with an object or objects 52 to which is it attached. The lifting loop 104 may be coupled to the level setting portion 106 with a pivoting connection such that the level setting portion 106 is substantially free to pivot relative to the lifting loop 104. In some embodiments, as shown, the level setting portion 106 may include a bolt, pin, shaft, or other mechanism 110 passing through a bottom portion of the lifting loop 104 where the lifting loop 104 and the pin 110 are free to pivot relative to one another about an axis parallel to the pin 110, for example. The pin 110 may include one or more bushings arranged along the pin 110 and on opposite sides of the lifting loop 104 to maintain the position of the lifting loop 104 along the pin 110.

The leveling setting portion 106 may be coupled to the lifting loop 104 via the pin 110 or other freely pivoting mechanism. The level setting portion 106 may include a tension carrying and/or vertical establishment element 112 and a horizontal establishment piece 114. The tension carrying element 112 may extend from the lifting loop 104 to the adjustable beam assembly 108. The tension carrying element 112 may be coupled to the beam assembly 108 such that the beam assembly 108 and the tension carrying element 112 are free to pivot relative to one another. For example, the tension carrying element 112 may be coupled to the beam assembly 108 with a bolt, pin, shaft, or other mechanism 116 allowing the tension carrying element 112 and the adjustable beam assembly 108 to pivot substantially freely relative to one another about an axis parallel to the pin 116, for example.

In some embodiments, the tension carrying element 112 may be akin to a link including two plates arranged adjacent to one another and separated by a gap. The gap may be configured to receive the lifting loop 104 and a portion of the adjustable beam assembly 108 there between. The tension carrying element 112 may include a hole in each plate for receiving the lifting loop pin 110 and the adjustable beam assembly pin 116. As such, the tension carrying element 112 may extend between the lifting loop 104 and the adjustable beam assembly 108 with little to no capacity to receive and/or transmit moment forces across the pinned connections between the parts. As such, when loaded, the tension carrying element 112 may define a substantially vertical direction defined by a line parallel to a line connecting the lifting loop pin 110 to the adjustable beam assembly pin 116.

The horizontal establishment element 114 may extend laterally from the tension carrying element 112 and may be arranged substantially perpendicularly to the vertical direction. In some embodiments, the horizontal establishment element 114 may include a leveling bar or plate, for example, extending between the plates of the tension carrying element 112 and extending laterally from the plates. Each end of the leveling bar 114 may include a contact trigger 118 configured for contacting a sensor or switch 120 to indicate that the adjustable beam assembly 108 is out of level. In some embodiments, the contact trigger 118 may include an adjustment screw, pin, or bolt, as shown. The adjustment screw 118 may threadably engage the leveling bar 114 and extend through the leveling bar 114 generally perpendicularly. The adjustment screw 118 may include a lock nut 122 such that the adjustment screw 118 may be threadably adjusted to position the bottom end of the screw 118 at a selected position and the lock nut 122 may be tightened against the surface of the leveling bar 114 to maintain the position of the adjustment screw 118. The adjustment screws 118 at each end of the leveling bar 114 may be threadably adjusted to define a level condition and to allow for a tolerance gap 124 between the bottom end of the screws 118 and the sensor or switch 120 such that the adjustable beam assembly 108 is allows to tip within a given tolerance without actuating the self-adjustment system.

Turning now to the adjustable beam assembly 108, reference is again made to FIG. 3. As shown, the adjustable beam assembly 108 may include a structural spreader beam portion and an adjustment portion. The structural spreader beam portion may include a center bridge 126, a pair of hanger arms 128, and a main beam span 130. The structural spreader beam portion may be configured to establish the substantially stationary portion of the adjustable beam portion that transfers load from the adjustment portion to the level setting portion and further on to the picking loop. The adjustment portion may be arranged on the structural spreader beam portion and may include one or more sensors or switches 120, a power source 132, a motor or actuator 134, a gear system 136, and a secondary beam portion 138 configured to translate relative to the main beam portion 130. The adjustment portion may be configured to adjust the position of the secondary beam portion 138 relative to the main beam span 130 to maintain the whole of the adjustable beam assembly 108 in a balanced condition.

As mentioned, the structural spreader beam portion may include a center bridge 126, a pair of hanger arms 128, and a main beam span 130. The center bridge 126 may be pivotally connected to the level setting portion 106 via the adjustable beam assembly pin 116. The center bridge 126 may be configured to provide an initial or small amount of spreader action for bridging over a transfer case 140 or other aspect of the adjustment portion, for example. That is, the center bridge 126 may be adapted to receive hanger loads at its outer ends and transfer those loads to the pin 116 through a moment and shear capacity of the bridge 126. The center bridge 126 may be in the form of a plate or bar or it may be built up from a series of plates or bars. As shown in FIG. 3, the adjustable beam assembly pin 116 may be arrange relatively close to the leveling bar 114. In other embodiments it may be further away. However, in the present embodiment, the center bridge 126 may include a peaked top surface culminating at the pin connection such that the center bridge 126 may tip about the pin 116 without contacting or interfering with the leveling bar 114. The tolerance gap 124 mentioned above with respect to the adjustment screw 118 may be selected and/or coordinated with the amount of slope of the bridge 126 to avoid contact between the top of the bridge 126 and the leveling bar 114.

The center bridge 126 may extend laterally from the pin 116 to provide space for a transfer case 140 or other mechanism of the adjustment portion of the adjustable beam assembly 108. In some embodiments, the center bridge 126 may extend across the middle ¼ of the main beam span 130 or across the middle ⅓, or across the middle ½ of the main beam span 130. As will be appreciated, where the center bridge 126 is relatively long, the design moment capacity may be relatively high and where the center bridge 126 is relatively short, the design moment capacity may be relatively low.

As shown, the outer ends of the center bridge 126 may be secured to the main beam span 130 with a pair of hanger bars 128. As shown each of the hanger bars 128 may include a substantially plate-like element extending downward from the center bridge 126, past the bottom of the center bridge 126 and to the main beam span 130. The hanger bars 128 may also include an outwardly extending leg along the surface of the main beam span 130 for attachment to the main beam span 130. In some embodiments, the hanger bars 128 may include a stiffener or stiffeners to more suitably extend the load outward along the outwardly extending leg. The hanger bars 128 may have a length configured to accommodate the transfer case 140 of the adjustment portion of the adjustable beam assembly 108 and may, thus, offset the center bridge 126 from the main beam span 130. It is to be appreciated that the hanger bars 128, while shown as angle shapes may be any relatively rigid hanger material including rods, plates, bars, and the like. However, when considering the design of the hanger bars 128, it is to be appreciated that some capacity to resist racking of the structural beam portion may be desired such that when the beam tips (i.e. prior to self-adjusting), the center bridge 126 and hanger bars 128 may remain square to the main beam span 130 and as such, some capacity to resist bending or warping may be desired.

Figure 4:
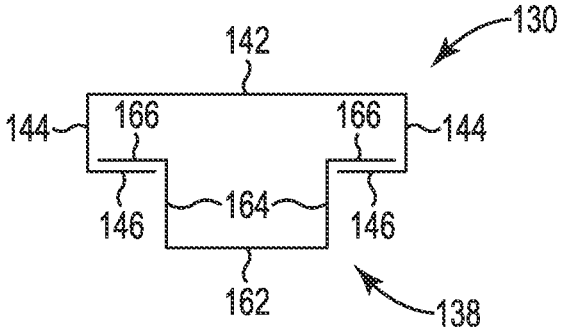
FIG. 4 shows a cross-section view of the spreader beam of the system of FIG. 1, according to one or more embodiments.

The main beam span 130 may extend across the bottom end of the hanger bars 128 and may be arranged generally parallel to the center bridge 126. The main beam span 130 may be configured to receive loads from the secondary beam portion 138, which may be arranged in a variety of positions along the main beam span 130. The main beam span 130 may also be adapted to transfer those loads to the hanger bars 128 via a shear and moment capacity of the main beam span 130. With reference to FIG. 4, in some embodiments, the main beam span 130 may be a channel shape, for example, having a web portion 142, a pair of opposing flanges 144 extending from each edge of the web 142, and a pair of return lips 146 extending inwardly from the flanges 144 and substantially parallel to the web 142. The channel may be arranged on its side with the open side facing downward and away from the center bridge 126. The channel shaped may be designed to support a wide range of loading including a wide range of load sizes as well as a wide range of load positions and the channel may be designed to carry those loads alone or in conjunction with the secondary beam portion 138. As will be described, the return lips 146 on the channel shaped may provide a track along which the secondary beam portion 138 may translate relative to the main beam span 130. This lip 146 may, thus, include a slide or skid material and/or may be greased or otherwise lubricated to allow the secondary beam portion 138 to slide along the main beam span 130. It is to be appreciated that while a channel shaped main beam span 130 has been shown, a variety of shapes may be provided such as I-shapes, box or tube shapes, pipe shapes, or other shapes. In addition, the main beam span 130, as well as other aspects of the system may be constructed from structural steels selected to provide suitable design capacities with respect to yield strength, ultimate strength, elasticity, and the like.

It is also to be appreciated that while discrete elements are described herein for the structural spreader beam portion, these listed elements may, alternatively, be more integrally constructed as part of a single spreader beam portion with the same or similar functionality. In some embodiments, where these elements are integrally formed, one or more of the elements may be removed such as, for example, the hanger arms 128 and the center bridge 126.

As mentioned, the adjustment portion of the adjustable beam assembly 108 may include one or more sensors or switches 120, a power source 132, a motor or actuator 134, a gear system 136, and a secondary beam portion 138 configured to translate relative to the main beam portion 130. As shown in FIG. 3, the one or more sensors or switches 120 may be positioned relatively rigidly on the structural beam portion such that the sensors or switches 120 move substantially simultaneously and together with the structural beam portion. As shown, in some embodiments, the sensors or switches 120, may, for example, be arranged with brackets 148 extending from the hanger bars 128. In other embodiments, the sensors or switches 120 may be arranged on the main beam span 130 or on a portion of the center bridge 126, for example. The sensors or switches 120 may be arranged in general alignment with adjustment screws 118 on the leveling bar 114 such that, as the structural beam portion tips, the sensors or switches 120 move closer to or further away from the adjustment screws 118 depending on which way the beam tips. When the beam tips such that the sensors or switches travel through the length of the tolerance gap 124, one of the sensors or switches 120 may contact the bottom end of its associated adjustment screw 118 causing the self-adjustment system to be actuated. It is to be appreciated, that when loaded, the leveling bar 114 may be maintained in a substantially level condition due to the load acting through the tension carrying element 112 of the level setting portion 106. As such, when the leveling screw 118 is contacted by the sensor or switch 120, the leveling bar 114 and screw 118 may have substantial resistance to moving away from level due to the tension in the tension carrying element 112 and, as such, the switch 120 may be readily actuated. It is to be appreciated that while the sensors or switches 120 are shown as being arranged on the adjustable beam assembly 108 the sensors or switches 120 may also be arranged on the level setting portion in alignment with adjustment screws 118 or other contacts on the adjustable beam assembly.

The sensors or switches may take one or more of many potential forms. In some embodiments, the sensors or switches may be limit switches, proximity switches, micro switches or some other switch than indicates or reacts to the relative position of the leveling screw 118 and the switch. It is to be appreciated that, in some embodiments, a mercury switch or other type of leveling switch may also be used. In these embodiments, the level setting portion 106 may be omitted, for example, because this type of switch may be capable of recognizing whether the beam is level without reference to a level setting portion 106.

The adjustment portion of the adjustable beam assembly 108 may also include a power source 132. In some embodiments, each of the sensors or switches 120 may include its own power source 132 such that, when contacted, the switch 120 may complete a circuit between its respective power source 132 and the motor 134. In some embodiments, the power source 132 may include a battery, rechargeable battery, or other stored power source 132. In still other embodiments, the power source 132 may be provided by the crane or other material handling system 50. In these embodiments, electrical communication between the system 100 and the crane 50 may be provided by leads extending from the crane. In some embodiments, an umbilical cord 200 may provide power to the beam by extending upward along the crane boom to a coiling device 202 and downward from the coiling device 202 to the beam 100. The coiling device 202 may take-up excess cord 200 and/or release cord 200 that is extending to the beam 100 as the beam is raised and lowered, respectively, by movement of the travelling block.

In some embodiments, the umbilical cord 200 providing power may also include information cables for transferring information to/from the beam to the crane system. For example, in some embodiments, the beam 100 may include load sensors 194 and/or encoders 196 for gathering information about the loads on the beam and/or the movement of the beam and the information cables may allow for the information captured by the sensors 194 and/or encoders 196 to be transmitted to a processing system for further analysis and/or adjustments.

The adjustment portion of the adjustable beam assembly 108 may also include a motor or actuator 134. The motor or actuator 134 may function in conjunction with the one or more power sources 132 and the one or more sensors or switches 120 to activate a gear system 136 to translate the secondary beam portion 138 along the main beam span 130. The motor or actuator 134 may be arranged on the structural beam portion and secured in position relative to the main beam span 130. The motor or actuator 134 may be in conditional electrical communication with one or more power sources 132 via the sensors or switches 120 such that the motor may turn on or off based on which sensor or switch 120 is contacted or otherwise triggered. In some embodiments, the switches 120 may be wired to the motor 134 in opposite fashions such that when one switch 120 is triggered, the motor 134 may run in a first direction, but when the other switch 120 is triggered, the motor 134 may run in the opposite direction. The selected direction for each wiring arrangement may be based on the gear system 136 described below and may be adapted to translate the secondary beam portion 138 in a direction adapted to bring the beam 100 into balance as opposed to causing the beam to become more unbalanced. In some embodiments, the motor or actuator 134 may include, for example, a 12 volt, 24 volt, 250 volt or other motor. Still other motor types may be provided. In some embodiments, a 1750 RPM squirrel cage motor may be provided, for example.

Figure 5:
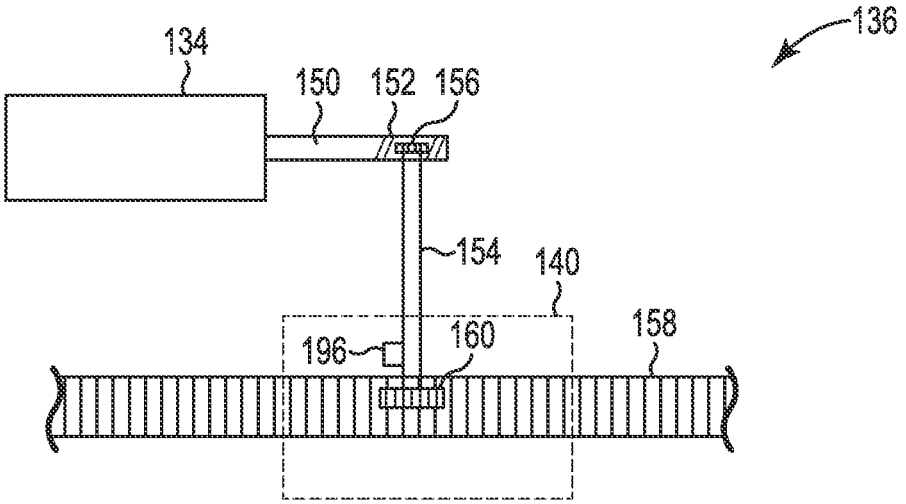
FIG. 5 shows a schematic diagram of a gear system for the spreader beam of the system of FIG. 1, according to one or more embodiments.

The gear system 136 may be configured to utilize the rotation of the motor or actuator 134 and cause the secondary beam 138 to translate along the length of the main beam span 130. Depending on the orientation and position of the motor 134, one of several gear arrangements 136 may be provided. In the present embodiment, and as shown in schematic view in FIG. 5, the motor 134 may be arranged along a back edge of the main beam span 130, for example, and a rotating shaft 150 may extend from one end. The shaft 150 may include a worm gear 152, for example, such that an offsetting shaft 154 extending generally perpendicularly to the motor 134 and including a gear 156 may be rotated by the action of the motor 134. The offsetting shaft 154 may be secured in position relative to the main beam span 130 and the motor 134, but may be free to rotate under the control of the motor 134. The offsetting shaft 154 may extend from the engagement with the motor 134 across the main beam span 130 and into a transfer case 140, for example, arranged on the main beam span 130. The transfer case 140 may house the gearing system between the offsetting shaft 154 and a rack/pinion system, for example, arranged in the main beam span 130. That is, the offsetting shaft 154 may extend from the motor shaft 150 to the transfer case 140, and may include a gear 160 at the beam end of the shaft 154. The secondary beam portion 138 may have a gear rack 158 extending substantially the full length of the secondary beam portion or some portion of the length. The gear rack 158 may be arranged on and/or secured to the secondary beam portion 138 such that, as the gear 160 rotates, the secondary beam translates relative to the main beam span 130. For example, the gear 160 at the beam end of the offsetting shaft 154 may have a portion extending through the web 142 of the channel portion of the main beam span 130 to engage the gear rack 158.

Accordingly, with the presently described gear system 136, the motor 134 may rotate in a first direction and the worm gear 152 may cause the offsetting shaft 154 to rotate in a first direction. The rotating offsetting shaft 154 may engage the rack 158 on the secondary beam portion 138 causing the secondary beam portion 138 to translate along the main beam span 130. In addition, where the motor 134 rotates in an opposite direction, the offsetting shaft 154 may rotate in a direction opposite the first direction and the secondary beam 138 may translate in a direction opposite the first translation direction.

It is to be appreciated that other gearing systems may be provided and may be modified or changed depending on the position of the motor relative to the beam. In the present embodiment, the motor is arranged parallel to the beam and offset from the center line of the beam. In other arrangements, the motor may be placed in line with long axis of the beam and may be more directly geared to the secondary beam. However, it is to be appreciated that the present gear system may be advantageous because it may be resistant to movement outside of actuation by the motor. For example, the worm gear connection to the offsetting shaft may be resistant to rotation under forces along the beam and, as such, inadvertent or unactuated translation of the secondary beam portion 138 relative to the main beam span 130 may be avoided.

The secondary beam portion 138 may be configured for support by and translation along the main beam span 130. The secondary beam portion 138 may be adapted to slidably engage the main beam span 130 and may, thus, be shaped to cooperate with the shape of the main beam span 130. In the present embodiment, as shown in FIG. 4, the secondary beam portion 138 may include a web portion 162, a pair of flanges 164, and a pair of outwardly extending lips 166 for engaging the inwardly extending lips 146 of the main beam span 130. As shown, the pair of outwardly extending lips 166 may be seated against and supported by the inwardly extending lips 146 of the main beam span 130. These opposing lips 146/166 may provide a sliding engagement between the secondary beam portion 138 and the main beam span 130 allowing the secondary beam portion 138 to translate relative to the main beam span 130. It is to be appreciated that this may allow the secondary beam span 138 to telescope relative to the main beam span 130 and maintain its alignment with the main beam span 130. The sliding may be facilitated by slide surfaces such as nylon or lubrications may be provided. In still other embodiments, bearings may be provided to provide for the relative motion of the parts. Still other systems may be provided for accommodating the relative motion of the parts.

It is to be appreciated that where an alternatively shaped main beam span 130 is provided, an associated secondary beam 138 shape may be provided. For example, where an I-shaped main beam span 130 is provided, the secondary beam 138 may include a channel shape with inwardly extending lips for engaging the top surface of the bottom flange of the I-shape. Still other combinations of shapes may be provided.

The secondary beam portion 138 may have slings 102 connected to it that may extend downwardly to secure to an object or objects. In some embodiments, as shown in FIG. 3, the slings 102 may be secured to the secondary beam portion 138 and may extend downward to a pulley or sheave 168 with a hook and back upward to the secondary beam span 138. The tension in each line of the sling 102 may be equalized by the pulley or sheave 168 so as to avoid imparting a tipping action on the spreader beam 100. The secondary beam portion 138 may include one or more locations along its length for securing slings 102 to lift an object. While two slings 102 have been shown, any number of slings 102 may be provided to lift an object or objects. The slings may be secured to the spreader beam with load cells that may be capable of measuring the tension in the slings. These load cells may be connected and/or communicatively coupled to the information cable or line in the umbilical cord 200 for transmitting information from the beam to a control center or controller, which may be in the cab of the crane for example. The load cells may be used to determine the total amount of load that is being lifted such that the crane and beam may avoid being overloaded.

It shall be appreciated that the presently disclosed spreader beam may be used to lift entire oil rig platforms and may range in length from approximately 20 feet to approximately 200 feet or from approximately 50 feet to approximately 150 feet or from approximately 75 feet to approximately 125 feet or it may have a length of approximately 100 feet. In some embodiments, the center-to-center dimension of the outer most lifting slings may be approximately 80 feet or approximately 60 feet. Still other sizes of beams and sling spacings may be used where the beam sizes and sling spacings may be outside or inside the ranges mentioned.

Figure 6:
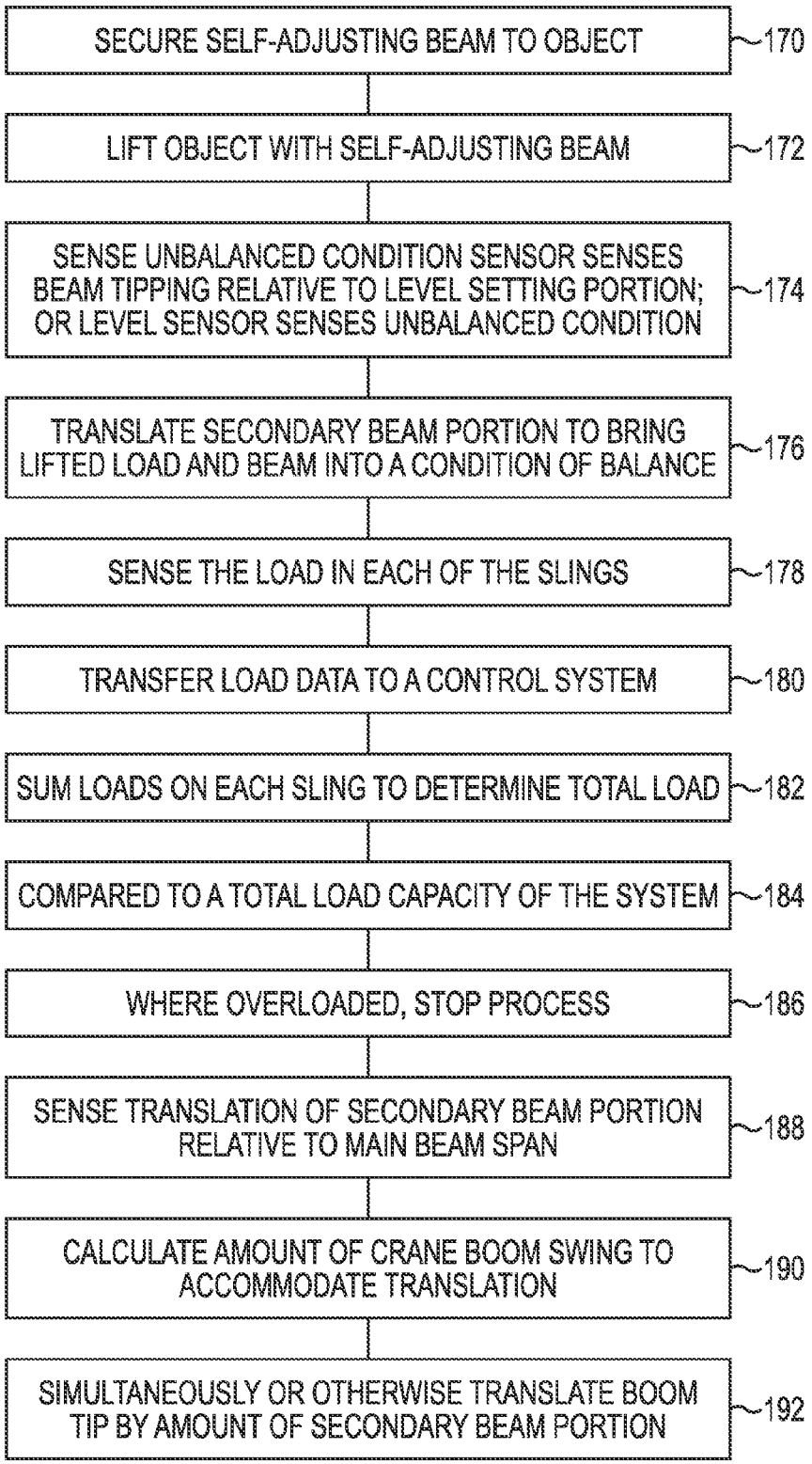
FIG. 6 shows a block diagram of a series of method steps performable with and/or by the self-adjusting spreader beam system of FIG. 1, according to some embodiments.

In use, and with reference to FIG. 6, the self-adjusting spreader beam 100 may be secured to an object or objects with a pair of slings or more slings 102. [Block 170]. The material handling system 50 may be activated to begin lifting the self-adjusting beam 100 together with the object. [Block 172]. As the slings 102 are drawn taut, the beam 100 may be in a balanced condition or an unbalanced condition. Where the beam 100 is in an unbalanced condition, the adjustable beam assembly 108 may begin to tip, together with the sensors or switches 120 secured thereto. As the assembly 108 tips, the sensors or switches 120 may be engaged by a respective adjustment screw 118 causing the circuit between the power source 132, the switch 120, and the motor 134 to be completed. [Block 174]. This may activate the motor 134 causing the gear system 136 to activate and the secondary beam portion 138 to translate in a direction to bring the lifted load into a condition of balance. [Block 176]. For example, in FIG. 3, for example, if the adjustable beam assembly tips in a counterclockwise direction, the right sensor or switch 120 may engage its respective adjustment screw 118, causing the motor 134 to activate. The gearing system 136 and motor rotation may be configured, in this condition, to cause the secondary beam portion 138 to translate to the right along the length of the main beam span 130. The secondary beam span 138 may translate along the main beam span 130 as long as the right sensor or switch 120 maintains its engagement with the adjustment screw 118 and when the load has shifted sufficiently to disengage the switch 120 and adjustment screw 118, the disengagement may cause the motor 134 to stop and maintain the balanced condition. It is to be appreciated that where the load is unbalanced in the opposite direction (i.e., clockwise) the system may react in an opposite way causing the secondary beam portion 138 to translate the opposite direction and bring the system 100 into balance. As such, the system 100 may bring the beam into balance causing the moment due to the slings 102 about the lifting line or lines 58 to be substantially the same.

In some embodiments, where a mercury switch is used, for example, the a similar method may be performed by the system. In this embodiment, however, the level setting portion may be omitted and the switch may naturally determine the levelness of the beam. When the beam tips one direction, a mercury element may flow in the tipped direction causing electrical contact between a positive and a negative lead through the conductive mercury and making a connection and causing actuation of the motor to balance the beam by translating the secondary beam portion. When the beam reaches a balanced condition, the mercury element may flow away from the positive and/or negative lead, causing the motor to stop. When the beam tips the other direction, contact between a different pair of lead or at least one other lead may be made by the mercury element causing the motor to run in an opposite direction and balancing the beam in the opposite manner.

In some cases, the load cells on the slings of the beam may be used to avoid overloading the beam and/or crane. The load cells may sense the load in each of the slings and this information may be transferred back to a control system 198 on or off the crane via the information cables in the umbilical cord 200. [Block 178/180]. It is to be appreciated that such information transfer may be transmitted wirelessly as well or alternatively. In either case, the loads from each of the load cells may be summed by the control system 198 and a total load may be determined and compared to a total load capacity of the system. [Block 182]. Where the load exceeds some predetermined value, the process may be stopped to avoid overloading one or more aspects of the system. [Block 184/186].

In addition to the above use, the system may be adapted to avoid dragging loads laterally as the secondary beam shifts to balance the load. For example, if the secondary beam portion 138 is triggered to move a distance X to the right, the tip of the crane boom may be simultaneously or otherwise swung a distance X to the left to maintain the position of the main beam span 130 and the object while the beam is brought into a condition of balance. In this embodiment, the encoder 196 on the beam may track the amount of movement of the secondary beam portion 138 relative to the main beam span 130. [Block 188]. The encoder 196 may be in communication with a control system 198 on the beam, in the cab of the crane, or at some other location and may transmit translation information to the control system 198. The controller 198 may be adapted to control the crane boom to swing a corresponding distance the opposite direction of the movement so as to accommodate the movement of the secondary beam portion relative to the main beam span 130. For example, the controller may track the vertical angle and length of the crane boom so as to track the radius at which the boom tip is located relative to the center pivot point of the crane. With that information, when the secondary beam portion 138 moves, for example, 1 foot, the crane may pivot to swing the boom tip 1 foot, the opposite direction. The controller may calculate the amount of pivot in radians by, for example, dividing the amount of travel by the radius dimension to the boom tip. [Block 190]. The result, may be to cause the crane to pivot about a center point causing the boom tip to travel to the center of gravity of the lifted object while the self-adjusting spreader beam maintains the vertical position of the secondary beam portion 138 directly above the lifted object with substantially vertically extending slings. The movement of the secondary beam portion 138 and the crane boom may be performed substantially simultaneously so as to avoid dragging the object and or imparting substantial lateral forces on the spreader beam system 100. [Block 192].

It is to be appreciated that while several operations are shown in FIG. 6 as part of an overall process some parts of the process may be performed by a user (e.g., securing the beam to an object), some portions may be performed by the beam (e.g., translate secondary beam portion), and some portions may be performed by a controller and/or crane (e.g., translate boom tip of crane). Any of these processes or groups of process may stand on their own and be claimed on their own as well as in combination with one another and the presence of the several operations in FIG. 6 shall not limit the operations to being performed together nor shall FIG. 6 require the operations to be performed in a particular order.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A lifting device, comprising:

a lifting loop;

a level setting portion, pivotally secured to the lifting loop; and an adjustable beam assembly pivotally secured to the level setting portion, comprising:

a structural beam portion configured for spanning laterally from the level setting portion; and an adjustment portion configured for securing to a load to be lifted and transferring forces from the load to the structural beam portion, the adjustment portion further configured for translating along the structural beam portion;

wherein the adjustable beam assembly includes a sensor for sensing when the structural beam portion is unbalanced and an actuation system for translating the adjustment portion to bring the structural beam portion into a balanced condition.

2. The lifting device of claim 1, wherein the level setting portion comprises a tension carrying element and a leveling bar extending laterally relative to the tension carrying link.

3. The lifting device of claim 2, wherein the leveling bar comprises a pair of adjustment screws extending downward therefrom.

4. The lifting device of claim 3, wherein the sensor includes a switch arranged in alignment with each of the adjustment screws.

5. The lifting device of claim 4, wherein, when the structural beam portion is in an unbalanced condition, the sensor is brought into contact with the adjustment screw.

6. The lifting device of claim 5, wherein contact with the adjustment screw triggers the switch causing the adjustment portion to translate.

7. The lifting device of claim 1, wherein the structural beam portion comprises a main beam span and the adjustment portion comprises a secondary beam portion configured to telescopically engage the main beam portion.

8. The lifting device of claim 7, wherein the adjustment portion comprises a power source and a motor, the power source in electrical communication with the sensor and conditionally in electrical communication with the motor when the sensor is triggered.

9. The lifting device of claim 8, wherein the motor is in mechanical communication with the secondary beam portion such that triggering of the sensor causes the secondary beam to translate relative to the main beam span.

10. The lifting device of claim 9, wherein mechanical communication is provided by a plurality of gears.

11. The lifting device of claim 10, wherein the main beam span comprises a worm gear for translating the secondary beam along the main beam span.

12. The lifting device of claim 1, further comprising a lifting loop configured for receiving a lifting hook to lift the lifting device.

13. The lifting device of claim 12, wherein the level setting device is pivotally secured to the lifting loop.

14. A lifting device, comprising:

a spreader beam configured for picking broad objects with a plurality of slings, the spreader beam comprising:

a means for mechanically defining a level condition;

a means for adjusting the beam to bring the beam into a balanced condition when the beam is deteiinined to not be level.

15. The lifting device of claim 14, wherein the means for adjusting comprises a translating means for adjusting the position of the slings.

16. The lifting device of claim 15, wherein the means for adjusting comprises an actuating means for actuating the translating means.

17. The lifting device of claim 16, wherein the means for adjusting comprises a mechanical coupling means for mechanically coupling the actuating means to the translating means.

18. A method of balancing a spreader beam, comprising:

sensing a non-level condition of the spreader beam;

translating a portion of the spreader beam to bring the beam into a condition of balance; and adjusting a position of a boom tip to accommodate the translating and avoid dragging of a lifted object.

19. The method of claim 18, wherein sensing a non-level condition, comprises contacting a switch with an adjustment screw.

* * * * *